US005226192A

United States Patent [19]

Jones et al.

[11] Patent Number: 5,226,192

[45] Date of Patent: Jul. 13, 1993

[54] ATTACHMENT FOR REMOVABLE PADDING

[75] Inventors: Michael J. Jones; Jeffrey D. Douglas, both of Houston, Tex.

[73] Assignee: Douglas Protective Equipment, Inc., Houston, Tex.

[21] Appl. No.: 827,266

[22] Filed: Jan. 29, 1992

[51] Int. Cl.[5] ..... A61F 5/02

[52] U.S. Cl. ..... 2/44; 2/45; 2/267; 2/268; 2/2

[58] Field of Search ..... 2/44, 45, 2, 267, 268

[56] References Cited

U.S. PATENT DOCUMENTS

| | | | |
|---|---|---|---|
| 1,640,654 | 8/1927 | Goldsmith et al. | 2/2 |
| 1,687,126 | 10/1928 | Goldsmith | 2/2 |
| 2,071,827 | 2/1937 | Glahe | 2/2 |
| 3,867,726 | 2/1975 | Owl et al. | 2/2 |
| 4,302,849 | 12/1981 | Margetson | 2/45 |
| 4,320,537 | 3/1982 | Mitchell | 2/2 |
| 4,547,905 | 10/1985 | La Porta, Jr. | 2/2 |
| 4,590,622 | 5/1986 | Wolfe et al. | 2/2 |
| 4,698,845 | 10/1987 | Cosby | 2/2 |
| 4,698,846 | 10/1987 | Wang | 2/2 |
| 4,715,066 | 12/1987 | Mitchell et al. | 2/2 |
| 5,060,313 | 10/1991 | Neuhalfen | 2/45 |

*Primary Examiner*—Clifford D. Crowder
*Assistant Examiner*—Gloria Hale
*Attorney, Agent, or Firm*—Baker & McKenzie

[57] ABSTRACT

A fastening arrangement for protective equipment comprised of relatively soft inner cushioning material and relatively rigid outer shell-like material. The fastening is comprised of a main strap which has a fixed end and free end. The fixed end is sewn in place to both inner and outer fabric surfaces of a cushion. The free end of the strap is threaded through a series of three slots and through an opening formed by a transverse strap. The circuitous path of the main strap prevents separation of the cushion from the shell. Hook-and-loop fastening surface areas on different portions of the main strap allow it to be completed with one hand.

7 Claims, 1 Drawing Sheet

ATTACHMENT FOR REMOVABLE PADDING

BACKGROUND AND SUMMARY OF THE INVENTION

This invention relates to protective equipment, like the kind used in football and ice hockey. In particular, the invention relates to the attachment of cushions, which are relatively soft, to an outer shell of relatively hard material.

Shoulder, elbow and various other padding is required for the protection of athletes who participate in sports where substantial impact can be expected. For many years, shoulder pads and the like have been made of a rigid outer shell, the underside of which is covered with a soft cushion. In many such pads, the soft cushion and rigid shell were permanently attached to one another. More recently, systems have been devised whereby hook-and-loop strapping (e.g. Velcro® straps) are used to connect the cushion to the rigid shell of a shoulder pad. The use of hook-and-loop fasteners allows for the separation of the shoulder pad components so that they may be cleaned and repaired more easily. Examples of such systems are shown in U.S. Pat. No. 4,554,681 to Kirkland, and U.S. Pat. No. 4,486,901 to Donzis. The Kirkland device shows a system in which a hook-and-loop strap is sewn to one surface of a cushion by the use of a "doubler" which reinforces the fabric which forms the outer surface of the pad. In the Kirkland patent, one of the connections shown includes a single strap, the opposite ends of which extend through two parallel slots formed in the shell.

In the Donzis system, a single strap extends through a single slot formed near an edge of the shell of the pad. In the Donzis system, the connections are disposed at generally diametrically opposed edge locations to provide stability to the overall interconnection between the shell and the pad.

Problems which exist with respect to the prior art techniques for removably attaching cushions to shells include the fact that with some systems, two hands are required to tightly pull the cushion against the underside of the shell. Another difficulty relates to obtaining proper alignment, for example, when the straps extend over the edge of the shell. A further potential problem with prior art techniques relates to the fact that once the hook-and-loop surfaces are no longer engaged, the shell and cushion are quite easily separated. Still another difficulty relates to the manner by which the strap is fastened to the cushion. While the use of a reinforcement under the outer fabric may prevent the strap from being torn from the outer fabric of the cushion, attachment of the strap to only the outer fabric and its reinforcement means that the foam core and the inner fabric are only indirectly connected to the shell.

It is therefore an object of the present invention to provide a more effective attachment for use in connecting a cushion to an outer shell of a piece of protective equipment.

Another object of the invention is to provide an attachment means for protective equipment which can be completed by using one hand.

Still another object of the present invention is to provide a hook-and-loop fastening system for protective equipment which is more secure and more difficult to detach than prior art fastening techniques.

These and other objects and advantages of the invention are achieved with a fastening arrangement whereby a single strap is attached at one of its ends to a cushion, and the strap is wound through a series of three openings in a shell. The strap has mating hook-and-loop fastening surfaces disposed on the same side of the strap, one hook or loop surface at approximately the free end of the strap, and a mating hook or loop surface nearer the end of the strap which is attached to the cushion. The cushion includes a small transverse strap located a short distance away from the location where the main strap is connected to the cushion. The main strap extends from beneath the shell through a first slot in the shell across the outer surface of the shell back through a second slot in the shell and under the small transverse strap. The main strap then extends through a third slot and back upon itself so that the mating hook-and-loop surfaces can engage one another. The fastening of the present invention can be completed with one hand, i.e. the user can simply pull on the free end of the main strap and press it against itself.

BRIEF DESCRIPTION OF THE DRAWINGS

The various objects and advantages of the invention will be more fully understood when the detailed description of the invention is read in conjunction with the following drawings which accompany this specification:

FIG. 2 is a cross-sectional view taken along line 3—3 of FIG. 1;

DETAILED DESCRIPTION OF THE INVENTION

Figure 1:
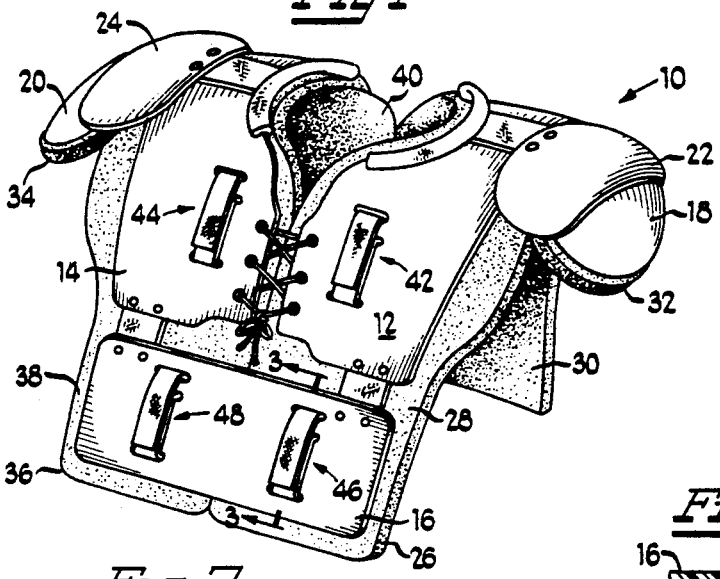
FIG. 1 is a perspective view of a shoulder pad held together by the fastening arrangement of the present invention.

Referring to the drawings, FIG. 1 shows a complete shoulder pad 10 comprised of outer shell components which are generally rigid and inner cushion components which are generally soft. The shell components include right and left arch shells 12 and 14, respectively, a backplate 16, and right and left shoulder shells 18 and 20, respectively. The cushion components include right and left arch cushions 26 and 36, respectively, and right and left shoulder cushions 32 and 34, respectively. The arch cushions 26 and 36 are comprised of back cushions 28 and 38, and breast cushions 30 and 40. The shoulder pad 10 also includes epaulets 22 and 24, which overlie the shoulder shells 18 and 20.

FIG. 1 shows the rear connections 42 and 44 which connect the back cushions 28 and 38 to the right and left arch cushions 12 and 14, respectively. The connections 46 and 48 connect the lower portion of the back cushions 28 and 38 to the backplate 16. The shoulder pad 10 of FIG. 1 also includes connections (not shown) between the right shoulder shell 18 and the right shoulder cushion 32, and between the left shoulder shell 20 and the left shoulder cushion 34. Also not shown are connections which hold the breast cushions 30 and 40 to the arch cushions 26 and 36.

Figure 2:
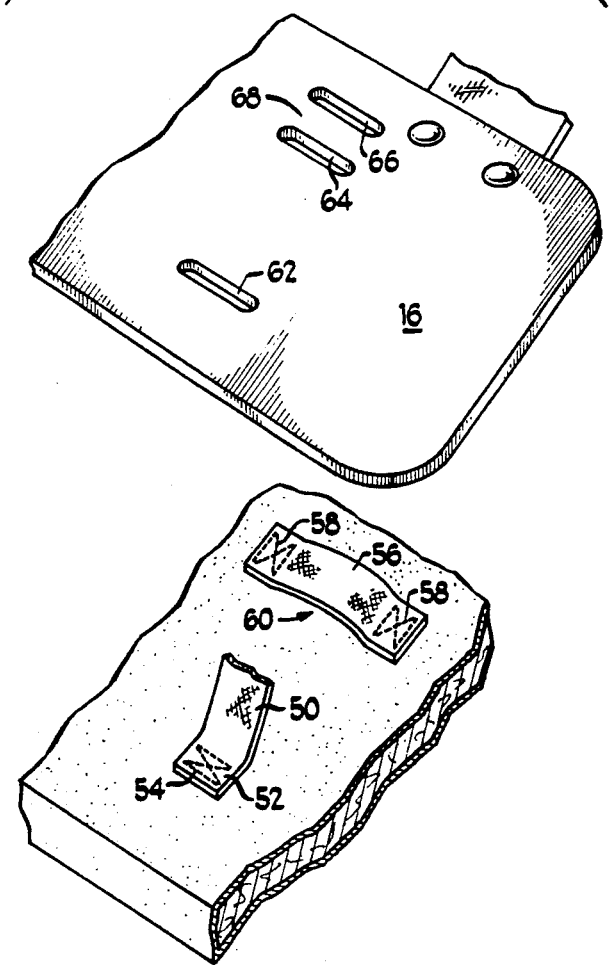
FIG. 2 is an exploded view showing a cushion and shell designed for use with the present invention.

FIG. 2 is an exploded view of some of the aspects of the connection 46 between the backplate 16 and the back cushion 28. A main strap 50 has a fixed end 52 which is sewn in place by stitching 54 to a position adjacent to the upper surface of the back cushion 28.

Similarly, a smaller transverse strap 56 is attached at both of its ends to the back cushion 28. The transverse strap 56 has a length such that after it is sewn in place by stitching 58, an opening 60 between the underside of the strap 56 and the back cushion 28 has a width which is slightly greater than the width of the main strap 50. The backplate 16 has three generally parallel slots 62, 64 and 66, each of which has a width slightly greater than the width of the main strap 50. The slots are not close to an edge of the backplate 16, and the strap which extends thought the slots holds central portions of the backplate 16, not edges thereof. The ends of the slots are generally in alignment with one another. The distance between slot 62 and slot 64 is approximately equal to the distance between the point at which the main strap is attached to the back cushion 28, and the long edge of the transverse strap 56 which is nearest to the stitching 54. The distance between slot 64 and slot 66 is approximately equal to the width of the transverse strap 56. The distance between the slots 64 and 66, and the width of the transverse strap 56 may depend upon the shear strength of the plastic used to form the backplate 16, since the bridge section 68 between slots 64 and 66 must resist at least a portion of the forces which may tend to separate the back cushion 28 from the backplate 16.

Figure 4:
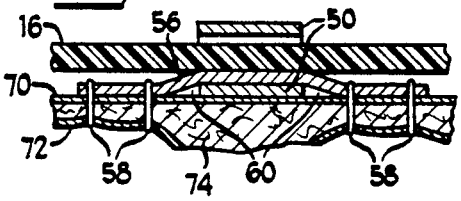
FIG. 4 is a cross-sectional view taken along line 4—4 of FIG. 3.
Figure 3:
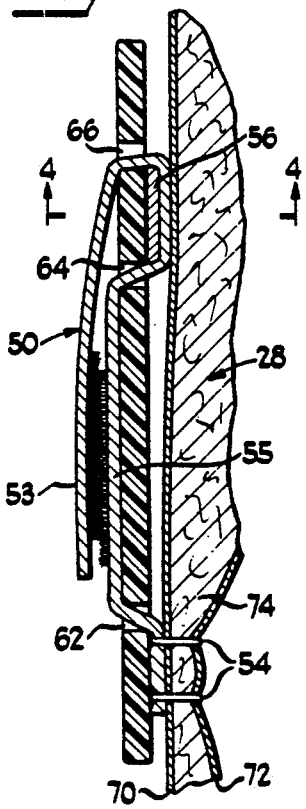

FIGS. 3 and 4 are cross-sectional views showing the cross-sectional configuration of the connection 46. In FIG. 3, the main strap 50 has its fixed end 52 attached by stitching 54 to the back cushion 28. The stitching 54 extends through the entire cushion 28 s that the stitching 54 is attached to both the outer fabric 70 and inner fabric 72 which enclose the foam core 74 of the cushion 28. By using a sticky arrangement which takes advantage of both the inner and outer fabrics, fastening is more secure and the entire cushion is held in place against the shell. The main strap 50 extends outwardly through the first slot 62 and across the upper and outer surface of the backplate 16. The main strap 50 then extends into the slot 64 and through the opening 60 underneath the transverse strap 56. The main strap 50 then extends out through the slot 66 and back upon itself where the hook-and-loop surfaces 70 and 72 attach to one another. The two mating hook-and-loop surfaces are both disposed on the same side of the strap 50. A hooked surface area 72 is formed on the free end 53 of the main strap 50, and a looped surface area 70 is formed on the middle portion 55 of the strap 50.

FIG. 4 shows the transverse 56 held in place by stitching 58 which extends through the entire cushion 28 tying the outer fabric 70 to the inner fabric 72. One portion of the main strap 50 extends through the opening 60, while another portion of the main strap 50 lies above the backplate 16. If the hook-and-loop connection between the surfaces 70 and 72 inadvertently becomes detached, the fastening of the present invention will still hold the cushion in place against the shell of the pad. The residual holding power of the fastening of the present invention is due to the circuitous path through which the main strap 50 extends.

In order to provide the user of the shoulder pad 10 with as much freedom of arm movement as possible, the shoulder cushions 32 and 34 are separate from the arch cushions 26 and 36, respectively. Since the shoulder cushions 32 and 34 are separate components, they need to be individually attached to the shoulder shells 18 and 20, respectively. A connection like the one described in FIGS. 2–4 is preferably disposed at about the center of the shoulder cushion 32 and the shoulder shell 18, and at about the center of the shoulder cushion 34 and the shoulder shell 20.

As discussed above, an additional advantage of the fastening of the present invention is that it can be tightened and completed with one hand. For example, a user can grab the free end 53 of the strap 50 and by pulling in the direction of the first slot 62, can tighten the connection. The free end 53 can then be pressed against the middle portion 55 of the strap 50 to complete the connection.

While a specific embodiment of the invention has been shown and described, it will be apparent to those skilled in the art that numerous alternatives, modifications, and variations of the embodiment shown can be made without departing from the spirit and scope of the appended claims.

We claim:

1. A fastening system for protective equipment, said fastening system comprising shell means of generally rigid material, cushion means attachable and removable from said shell means, main strap means having one free end and one end attached to said cushion means, said main strap means carrying hook-and-loop fastening means on one side thereof, said main strap means being engageable with and extending through said shell means, and free end of said strap means being attachable to an intermediate section of said main strap means to secure said cushion means to said shell means.

2. The fastening system of claim 1 wherein:

said shell means includes a plurality of at least three slots through which said strap means pass.

3. The fastening system of claim 1 wherein:

fastening includes transverse strap means attached to said cushion means to form a loop adjacent to said cushion means formed in said shell away from edges of said shell means.

4. The fastening system of claim 3 wherein:

said main strap means extends from its point of attachment to said cushion through a first slot across an outer surface of said shell means and through a second slot through said loop and beneath a third slot, said transverse strap being disposed beneath said shell between said second and third slots, and said transverse strap having a width approximately equal to the distance between said second and third slots, said free end of said strap means having hook-and-loop fastening means attachable to mating hook-and-loop fastening means carried by said intermediate section of said strap means extending between said first and second slots.

5. A fastening system for attaching a cushion to a rigid protective shell, said fastening system comprising a main strap, a transverse strap, and a plurality of three slots in said shell, one end of said strap being fixed to said cushion and extending through a first slot in said shell, a first length of said strap extending from said first slot and through a second slot in said shell, a second length of said strap extending from said second slot to and through said loop, a third length of said strap extending from said loop to and through a third slot in said shell, a fourth length of said strap extending from said third slot and overlying at least a portion of said first length of said strap, said first and fourth lengths of said strap being attachable to one another to prevent loosening of said strap from engagement with said slots.

6. The fastening system of claim 4 wherein:

said first and fourth lengths of said strap having mating hook-and-loop fastening surfaces.

7. The fastening system of claim 4 wherein:

said cushion includes a transverse retaining member, the ends of said transverse strap being attached to said cushion means, said transverse retaining member forming a loop adjacent to said cushion, said loop having a width approximately equal to the width of said strap, said retaining member having a width approximately equal to the distance between said second and third slots.

* * * * *